US008462591B1

(12) United States Patent
Marhaben

(10) Patent No.: US 8,462,591 B1
(45) Date of Patent: Jun. 11, 2013

(54) ISLAMIC PRAYER AND PEDOMETER WATCH

(76) Inventor: Sanaa Marhaben, Abu Dhabi (AE)

( * ) Notice: Subject to any disclaimer, the term of this patent is extended or adjusted under 35 U.S.C. 154(b) by 55 days.

(21) Appl. No.: 13/333,134

(22) Filed: Dec. 21, 2011

(51) Int. Cl.
*G04B 23/02* (2006.01)

(52) U.S. Cl.
USPC ..... 368/244; 368/15

(58) Field of Classification Search
USPC ..... 368/20, 11, 244, 14–17
See application file for complete search history.

(56) References Cited

U.S. PATENT DOCUMENTS 4,396,293 A * 8/1983 Mizoguchi ..... 368/15
4,659,231 A * 4/1987 Barkouki ..... 368/15
5,546,310 A * 8/1996 Ehdaie et al. ..... 701/541
8,400,882 B2 * 3/2013 Cunningham ..... 368/73
2003/0198138 A1 * 10/2003 Shebani ..... 368/21
2004/0013043 A1 * 1/2004 Haq ..... 368/21
2005/0007884 A1 * 1/2005 Lorenzato ..... 368/10

* cited by examiner

*Primary Examiner* — Sean Kayes
(74) *Attorney, Agent, or Firm* — Renner, Otto, Boisselle & Sklar, LLP

(57) ABSTRACT

A system and method is proposed that provides a scheduling device and system for notifying a user of Islamic prayer times, aiding the user in preparing to pray, and presents the user with data related to fitness. The system and method may comprise a portable electronic device and a notification system. The system may include a database storing information comprising a list of prayer times and Rakha numbers, the prayer times and the Rakha numbers being associated with a location and date. The portable electronic device may include a display, an electronic compass, a memory, an alarm, a pedometer, a location module, and a processor. The processor may be programmed to execute a program comprising the notification system, wherein the notification system comprises a scheduling function and an exercise function.

26 Claims, 4 Drawing Sheets

ISLAMIC PRAYER AND PEDOMETER WATCH

TECHNICAL FIELD OF THE INVENTION

The technology of the present disclosure relates generally to a system and method of notifying a user of approaching prayer time, aiding the user in preparing to pray, and presenting the user with data related to daily exercise.

BACKGROUND

The Five Pillars of Islam are presented in the Qur'an as a framework for worship and a sign of commitment to the faith. Fulfilling the obligations of three of the five pillars of Islam requires that Muslims be of sound health and fitness. The second pillar requires performance of five daily prayers. The prayers are to be performed at specific times that vary throughout the year depending on the rising and setting of the sun, which depends upon the date and geographical location. Prior to each prayer, ritual ablution, Wudo, is performed. Additionally, each prayer is performed facing Qibla (Mecca) and consists of the repetition of actions and words, where the specific action, specified by a Rakha number, varies according to the time of day and other circumstances.

A device is needed to aid Muslims in becoming/staying physically fit and in performing the five daily prayers, specifically notifying an individual in advance of the time to pray, the direction of Qibla, and the correct Rakha number.

SUMMARY

A system and method is proposed that provides a scheduling device and system for notifying a user of Islamic prayer times, aiding the user in preparing to pray, and presents the user with data related to fitness.

Features that are described and/or illustrated with respect to one embodiment may be used in the same way or in a corresponding way in one or more other embodiments and/or in combination with or instead of the features of the other embodiments.

According to one embodiment of the present invention, there is provided a portable electronic device comprising a notification system, the device comprising:

a database storing information comprising: a list of prayer times and Rakha numbers, the prayer times and the Rakha numbers associated with a selected location and date; exercise data comprising an exercise goal and an exercise total;

a display; an electronic compass; a memory; an alarm; a pedometer; a location module, wherein the location module is programmed to determine the system location;

a processor programmed to execute a program comprising a notification system, wherein the notification system comprises a scheduling function and an exercise function;

wherein the scheduling function is configured to: convert from current local time to Azan time; determine the direction of Qibla using an output from the electronic compass and the location module; update the display to show the current local time, Azan time, and direction of Qibla;

compare the current local time to the prayer times for the current date and location as stored in the database, such that:

if a next prayer time is within a duration of time less than an amount of time specified by a predetermined Wudo threshold, issuing a notification via the alarm and/or updating the display to show a Wudo icon;

if the next prayer time is within a duration of time less than an amount of time specified by a predetermined prayer threshold, issuing a notification via the alarm and/or updating the display to show a prayer icon and/or the Rakha number of the next prayer time, where the prayer threshold consists of a shorter duration of time then the Wudo threshold; and if the current local time is equal to the next prayer time, issuing a notification via the alarm and/or updating the display;

wherein the exercise function is configured to: retrieve pedometer exercise data from the pedometer; update the exercise total; and compare the exercise total to the exercise goal and update the display to indicate a relationship between the exercise total and the exercise goal.

According to one embodiment of the present invent, there is provided a portable electronic device comprising a notification system. The device comprises a database, a display, an electronic compass, a memory, an alarm, a pedometer, a location module, and a processor. The database stores information comprising: a list of prayer times and Rakha numbers, the prayer times and the Rakha numbers associated with a selected location and date, and exercise data comprising an exercise goal and an exercise total. The location module is programmed to determine the system location. The processor is programmed to execute a program comprising a notification system. The notification system comprises a scheduling function and an exercise function. The scheduling function is configured to: convert from current local time to Azan time, determine the direction of Qibla using an output from the electronic compass and the location module, and update the display to show the current local time, Azan time, and direction of Qibla. The scheduling function is also configured to compare the current local time to the prayer times for the current date and location as stored in the database. If a next prayer time is within a duration of time less than an amount of time specified by a predetermined Wudo threshold, the scheduling function issues a notification via the alarm and/or updates the display to show a Wudo icon. If the next prayer time is within a duration of time less than an amount of time specified by a predetermined prayer threshold, the scheduling function issues a notification via the alarm and/or updates the display to show a prayer icon and/or the Rakha number of the next prayer time. The prayer threshold consists of a shorter duration of time than the Wudo threshold. If the current local time is equal to the next prayer time, the scheduling function issues a notification via the alarm and/or updates the display. The exercise function is configured to: retrieve pedometer exercise data from the pedometer, update the exercise total, and compare the exercise total to the exercise goal and update the display to indicate a relationship between the exercise total and the exercise goal.

According to one embodiment, the exercise function further comprises: retrieving heart rate exercise data from a heart rate monitor; and updating the display to present the heart rate exercise data.

According to one embodiment, the exercise goal from the heart rate monitor exercise data further comprises a heart rate target range and a goal time period; the exercise total further comprises heart rate exercise data for a specified period of time; the exercise function further comprises: determining an actual time period, wherein the actual time period is equal to the amount of time the heart rate exercise data is within the heart rate target range; comparing the actual time period to the goal time period; and updating the display to indicate the relationship between the actual time period and the goal time period.

According to one embodiment, the Wudo icon and/or the prayer icon comprise a countdown indicator, wherein the countdown indicator signifies the time remaining until the next prayer time.

According to one embodiment, if the current local time is within the prayer threshold the Wudo icon is not displayed and if the current local time is within neither the prayer threshold nor the Wudo threshold, neither the Wudo icon nor the prayer icon is displayed.

According to one embodiment, the notification issued via the alarm comprises an audible signal, a tactile signal, a visual signal, or a combination thereof.

According to one embodiment, the location module comprises a GPS receiver.

According to one embodiment, the location module comprises information as to a current location received via user input.

According to one embodiment, the exercise goal comprises a number of steps to be taken within a period of time and the exercise total from the pedometer is first displayed in a first color and transitions to being displayed in a second color when the exercise total is equal to or greater than the exercise goal.

According to one embodiment, the exercise data readout progressively transitions from the first color to the second color starting from a side, as the exercise total increases.

According to another embodiment of the present invention, there is provided a portable electronic device comprising:

a display, an electronic compass, an alarm, a pedometer, a processor, a location module, a memory, and a controller for managing the device operations such that the electronic device is configured to:

convert from current local time to Azan time; display current local time and Azan time; determine the direction of Qibla using an output from the electronic compass and the location module; display the direction of Qibla; determine prayer times for the current date and location; record exercise data from the pedometer, the exercise data comprising an exercise goal and an exercise total; display an indicator of the exercise data that represents progress towards the exercise goal;

activate the alarm and/or display a Wudo icon on the display when a next prayer time is within a duration of time less than a Wudo threshold; activate the alarm and/or display a Prayer icon on the display when the next prayer time is within a duration of time less than a prayer threshold; and activate the alarm prior to the next prayer time.

According to one embodiment, the electronic device is a watch, timepiece other than a watch, or mobile phone.

According to one embodiment, the controller is configured to: retrieve heart rate exercise data from a heart rate monitor, the exercise data further comprising a heart rate target range, a goal time period, and heart rate exercise data for a specified period of time; and update the display to present the heart rate exercise data.

According to one embodiment, the exercise function further comprises: determining an actual time period, wherein the actual time period is equal to the amount of time the heart rate exercise data is within the heart rate target range; comparing the actual time period to the goal time period; and updating the display to indicate the relationship between the actual time period and the goal time period.

According to one embodiment, the portable electronic device further comprises a means for communicating with another electronic device, wherein the electronic device sends data to the other electronic device via the means for communicating.

According to one embodiment, the Wudo icon and/or prayer icon includes a countdown indicator, wherein the countdown indicator signifies the time remaining until the next prayer time.

According to one embodiment, if the current local time is within the prayer threshold the Wudo icon is not displayed and if the current local time is within neither the prayer threshold nor the Wudo threshold, neither the Wudo icon nor the prayer icon is displayed.

According to one embodiment, the alarm generates an audible signal, a tactile signal, a visual signal, or a combination thereof.

According to another embodiment of the present invention, there is provided a A method of presenting notifications relating to prayer and presenting exercise data with a portable electronic device, wherein the device comprises:

a display, an electronic compass, an alarm, a pedometer, and a location module;

wherein the method comprises:

converting from current local time to Azan time; displaying current local time and Azan time; determining the direction of Qibla using an output from the electronic compass and the location module; determining prayer times for a current date and location;

recording exercise data from the pedometer, the exercise data comprising an exercise goal and an exercise total; displaying an indication of the exercise data that represents a progress towards the exercise goal;

activating the alarm and/or displaying a Wudo icon when a next prayer time is within a duration of time less than a Wudo threshold; activating the alarm and/or displaying a Prayer icon when the next prayer time is within a duration of time less than a prayer threshold; activating the alarm prior to the next prayer time.

According to one embodiment, the device further comprises a heart rate monitor, and the method further comprises retrieving exercise data from the heart rate monitor, the exercise data further comprises a heart rate target range, a goal time period, and heart rate exercise data for a specified period of time; and displaying the heart rate exercise data.

According to one embodiment, the method further comprises: determining an actual time period, wherein the actual time period is equal to the amount of time the heart rate exercise data is within the heart rate target range; comparing the actual time period to the goal time period; and displaying a visualization of the relationship between the actual time period and the goal time period.

According to one embodiment, the Wudo icon and/or prayer icon includes a countdown indicator, wherein the countdown indicator signifies the time remaining until the next prayer time.

According to one embodiment, if the current local time is within the prayer threshold the Wudo icon is not displayed and if the current local time is within neither the prayer threshold nor the Wudo threshold, neither the Wudo icon nor the prayer icon is displayed.

According to one embodiment, the alarm comprises an audible signal, a tactile signal, a visual signal, or a combination thereof.

According to one embodiment, the device further comprises one or more communications interfaces.

According to one embodiment, the communications interfaces comprise one or more of a Bluetooth module, a Zigbee module, a wireless USB module, a USB connector, a mini- USB connector, a micro-USB connector, and a radio-frequency identification (RFID) chip.

DETAILED DESCRIPTION OF EMBODIMENTS

Figure 1:
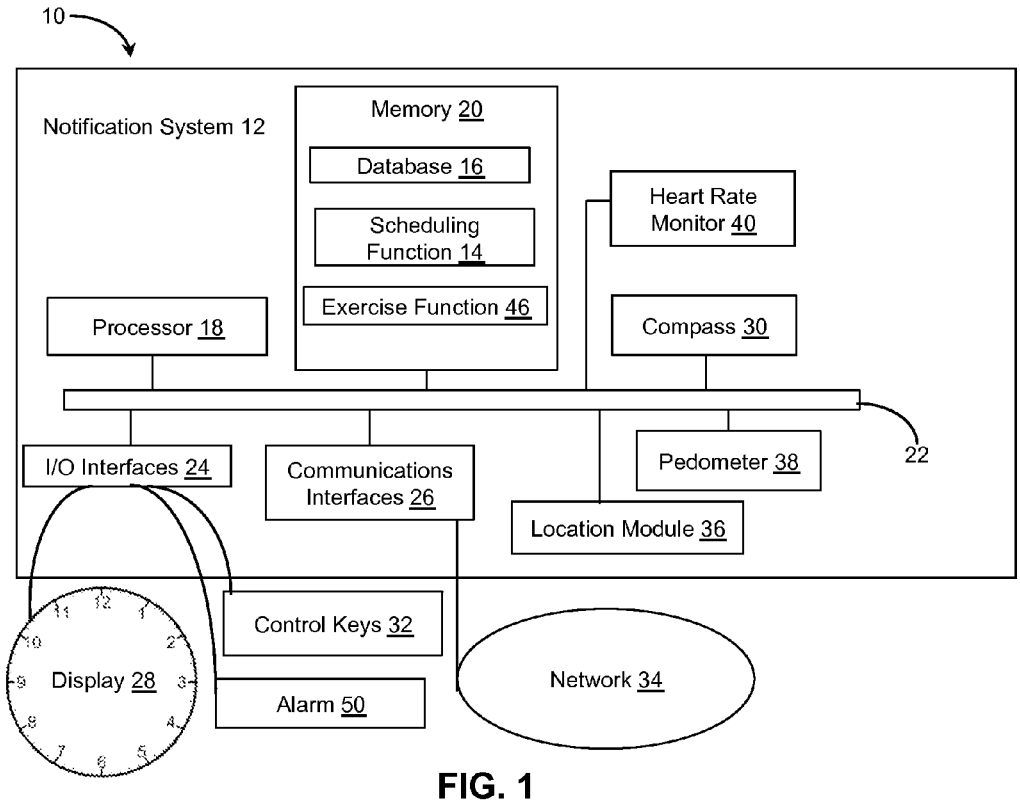
FIG. 1 is a schematic view of an exemplary system and device for alerting a user when prayer time is imminent, while also recording and displaying data from a pedometer and/or heart rate monitor.

Embodiments will now be described with reference to the drawings, wherein like reference numerals are used to refer to like elements throughout. It will be understood that the figures are not necessarily to scale.

With reference to FIG. 1, illustrated is a schematic block diagram of a portable electronic device 10. The portable electronic device 10 may comprise a wristwatch, pocket watch, timepiece, mobile phone, PDA, smart phone, computer, or other similar device. The portable electronic device 10 may include a notification system 12 that may be implemented using computer technology. The notification system 12 may be configured to execute a scheduling function 14, an exercise function 46, and to store a database 16 that comprises exercise data and data regarding Azan time, prayer time, and Rakha numbers. The data may include prayer times and Rakha numbers associated with a specific location, date, and time. The exercise data may comprise an exercise goal and an exercise total.

In one embodiment, the scheduling function 14 and exercise function 46 are embodied as one or more computer programs (e.g., one or more software applications including compilations of executable code). The computer program(s) and/or database 16 may be stored on a machine (e.g., electronic watch, electronic timepiece, mobile phone, etc.) readable medium, such as a magnetic, optical or electronic storage device (e.g., hard disk, optical disk, flash memory, etc.).

To execute the scheduling function 14 and exercise function 46, the notification system 12 may include one or more processors 18 used to execute instructions that carry out a specified logic routine(s). In addition, the notification system 12 may have a memory 20 for storing data, logic routine instructions, files, operating system instructions, and the like. As illustrated, the scheduling function 14, exercise function 46, and the database 16 may be stored by the memory 20. The memory 20 may comprise several devices, including volatile and non-volatile memory components. Accordingly, the memory 20 may include, for example, random access memory (RAM), read-only memory (ROM), flash devices and/or other memory components. The processor 18 and the components of the memory 20 may be coupled using a local interface 22. The local interface 22 may be, for example, a data bus with accompanying control bus or other subsystem.

The notification system 12 may have various input/output (I/O) interfaces 24. The I/O interfaces 24 may be used to operatively couple the portable electronic device 10 to various control keys 32 and so forth. The I/O interfaces 24 may also be used to couple the device to a display 28. The display 28 may be an analog watch face, a digital watch face consisting of a single or multiple LCD screens, a mobile phone display, or other suitable displays. The I/O interfaces 24 may also include an alarm 50. The alarm 50 may be used by the scheduling function 14 to notify the user at specific times prior to prayer time. Specific times include time to perform Wudo, time for prayer preparation, time just prior to the beginning of prayer time, user set alarms, and other times as required. The alarm 50 output may consist of, for example, one or more of a visual signal, an auditory signal, a tactile signal (e.g., vibration), or any suitable means of alerting a user. Different auditory signals may be used to notify the user depending on the reason for the notification, i.e., different auditory signals may be used to signify time to perform Wudo, time for prayer preparation, etc.

The notification system 12 may have one or more communications interfaces 26. The communications interfaces 26 may include, for example, a Bluetooth module, a Zigbee module, a wireless USB module, a USB connector, a mini-USB connector, a micro-USB connector, a radio-frequency identification (RFID) chip and/or other standard or non-standard/proprietary protocols. The communications interfaces 26 may enable the notification system 12 to send and receive data signals and the like to and from other computing devices via an external network 34 (e.g., direct data link, or similar systems). For example, the communications interfaces 26 may include a RFID chip that stores information to be shared with other users. The RFID chip may enable the portable electronic device 10 to be scanned by others, sharing the information stored in the RFID chip. The interface 26 between the system 12 and any operatively interfaced device or network may be wired or wireless.

In one embodiment, the electronic device 10 may have a unique identifier. The unique identifier may be associated with the data signals sent by the notification system 12 via the communications interfaces 26. For example, the notification system 12 may send to a server data signals related to the exercise data. The server may associate the unique identifier with a user of the website and incorporate the exercise data into the user's profile. For example, the website may display the user's exercise data and issue challenges to the user's contacts based upon the exercise data.

The notification system 12 may include an electronic compass 30. The electronic compass 30 may include magnetic field sensors, which supply detection signals. The detection signals may be utilized by the scheduling function 14 to calculate the direction of Qibla.

The notification system 12 may include a location module 36. The location module 36 may include a GPS receiver to determine the system location. A user using the control keys 32 may alternatively manually enter the system location. Alternatively, the system location may be set by data signals from the user or other devices communicated to the notification system 12 via the communications interfaces 26. The system location may be used by the scheduling function 14 to calculate the direction of Qibla.

The notification system 12 may also include a clock. The clock (not shown) may comprise an oscillator stage connected to a quartz resonator that forms part of the processor 18 for clocking various operations of the watch.

The notification system 12 may include an exercise function 46. The exercise function 46 may take as an input a pedometer 38 and/or a heart rate monitor 40. The exercise function 46 may retrieve exercise data form the pedometer 38 and heart rate monitor 40. The pedometer exercise data and/or heart rate exercise data may be displayed to the user on the display 28 and/or transferred to another device via the communications interfaces 26. The data may then be analyzed and displayed to the user on the other device. The other device may be any suitable device, such as a PDA, smart phone, cellular phone, or personal computer.

Figure 2A:
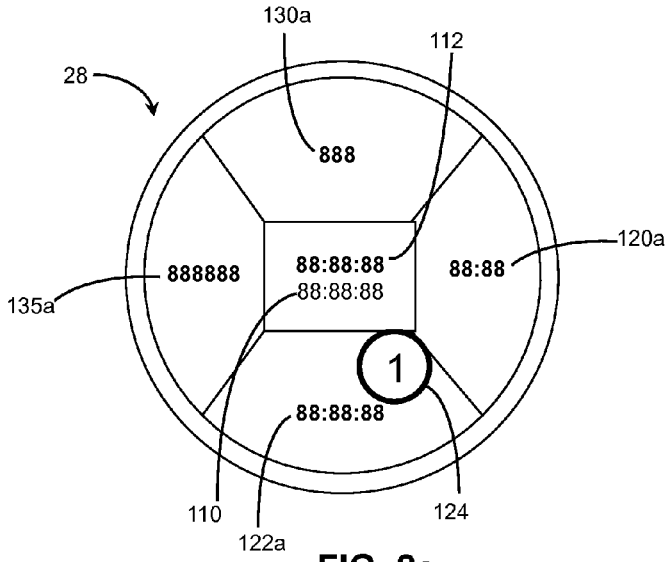
FIGS. 2*a* and 2*b* are a diagram depicting an exemplary display of the electronic device as described in FIG. 1.
Figure 2B:
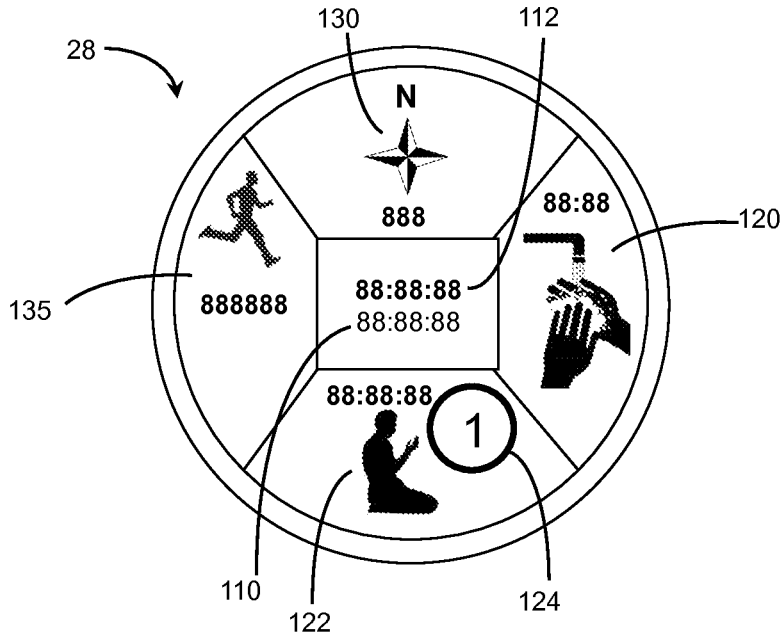

With reference to FIGS. 2*a* and 2*b*, an exemplary device display 28 is shown. The elements of the exemplary display 28 may be reordered or supplemented as necessary. For example, additional components, such as GPS location, etc. may also be added to the display.

In one embodiment described in FIG. 2*a*, the current local time 112 and Azan time 110 may be shown in the center of the display. Above the center of the display, a compass read out or other suitable means may identify the direction of Qibla 130*a*. To the left of the center of the display, the exercise data 135*a* may be numerically displayed. The displayed exercise data 135*a* may include the number of steps taken, the user's average heart rate, the user's current heart rate, the user's maximum heart rate, the user's minimum heart rate, the actual time period, or a combination thereof.

When prayer time is within a duration of time specified by the Wudo threshold, the time remaining 120*a* until prayer time or until the prayer threshold may be displayed to the right of the center of the display. Below the center of the display 28, the time remaining until prayer time 122*a* may be displayed. The time remaining until the next prayer time 122*a* may begin to flash as prayer time approaches. The time until the next prayer time may be displayed continuously, independently of how long until the next prayer time. When the prayer time 122*a* is displayed, the Rakha number 124 of the next prayer may be displayed. The Rakha number 124 may also be displayed when the prayer time 122*a* is not displayed.

In another embodiment described in FIG. 2*b*, the current local time 112 and Azan time 110 may be shown in the center of the display. Above the center of the display the direction of Qibla 130 may be shown. The direction of Qibla 130 may be shown with a representation of a compass needle, an arrow, or other suitable means. To the left of the center of the display, the exercise data 135 may be displayed with an icon. The displayed exercise data 135 may include the number of steps taken, the user's average heart rate, the user's current heart rate, the user's maximum heart rate, the user's minimum heart rate, the actual time period, or a combination thereof.

When prayer time is within a duration of time specified by the Wudo threshold, the Wudo icon 120 may be displayed to the right of the center of the display. The time remaining until prayer time or until the prayer threshold may be shown above the Wudo icon 120. Below the center of the display 28, the prayer icon 122 may be displayed when prayer time will occur in less than a predetermined duration of time, specified by the prayer threshold. The time remaining until prayer time may be shown above the prayer icon 122. The time remaining until the next prayer time may begin to flash as prayer time approaches. The time until the next prayer time may be displayed continuously, independently of how long until the next prayer time. When the prayer icon 122 is displayed, the Rakha number 124 of the next prayer may be displayed next to the prayer icon 122. The Rakha number 124 may also be displayed when the prayer icon 122 is not displayed.

Alternatively, with reference to FIG. 2*a*, neither the Wudo icon 120, nor prayer icon 122, nor countdown indicator may be displayed. Instead, the alarm function 14 may be activated to notify the user when prayer time is within a duration of time specified by the Wudo threshold, when prayer time is within a duration of time specified by the prayer threshold, and/or when prayer time is approaching.

Figure 3A:
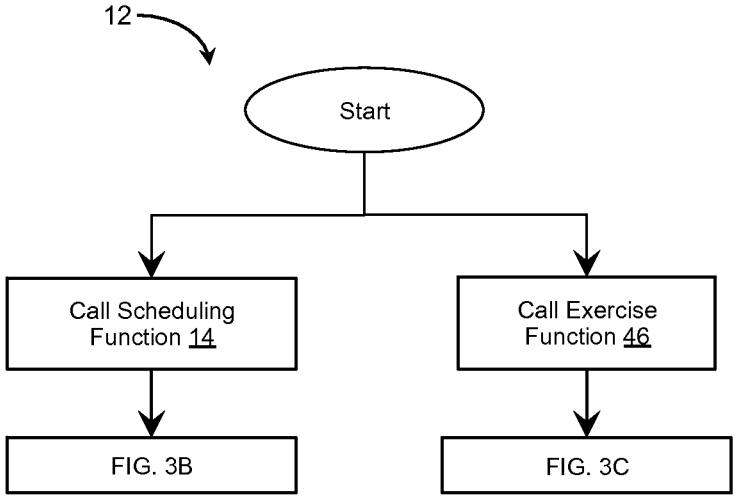
FIGS. 3*a-c* are flow diagrams representing exemplary actions taken by various components of the system of FIG. 1.
Figure 3B:
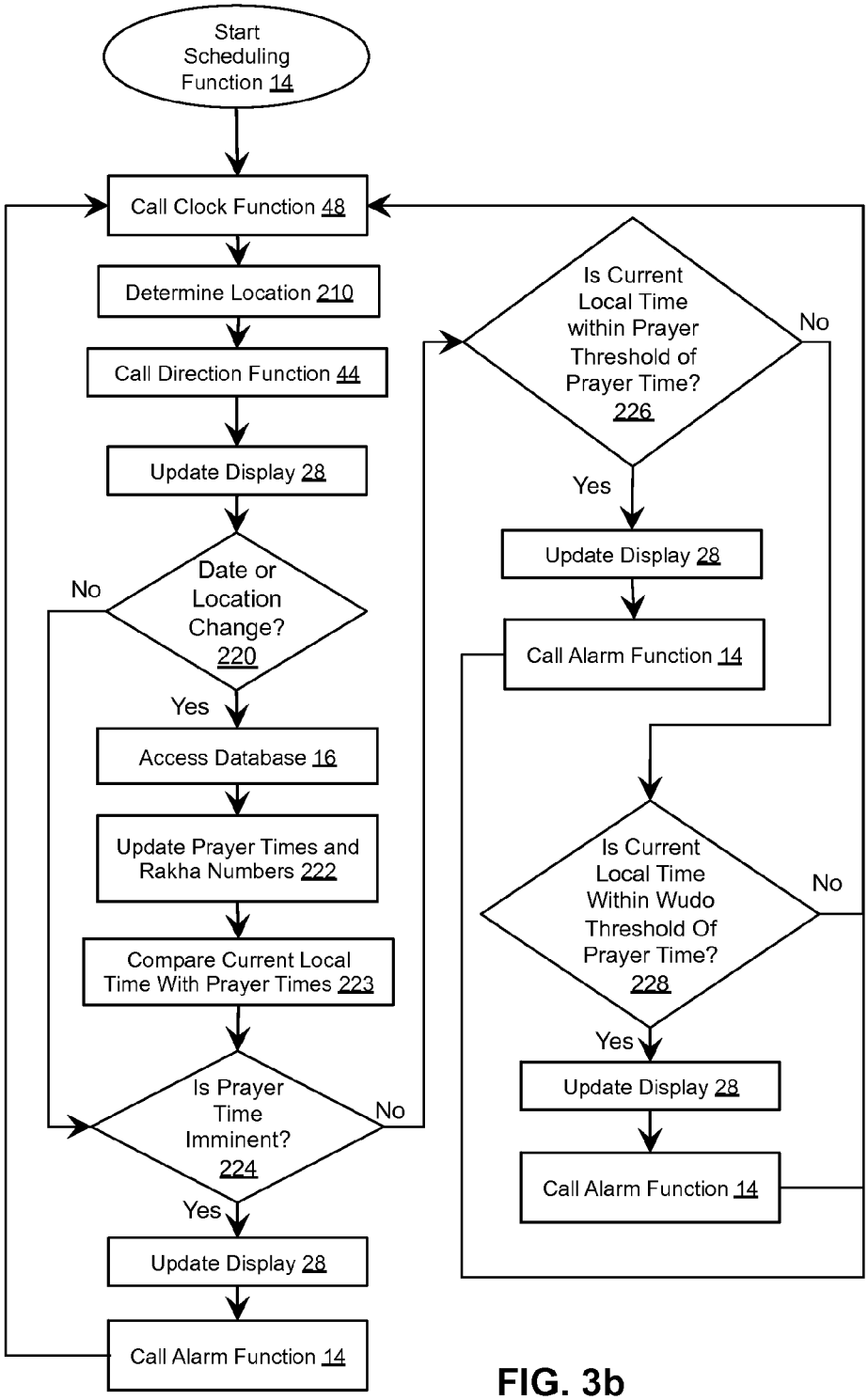
Figure 3C:
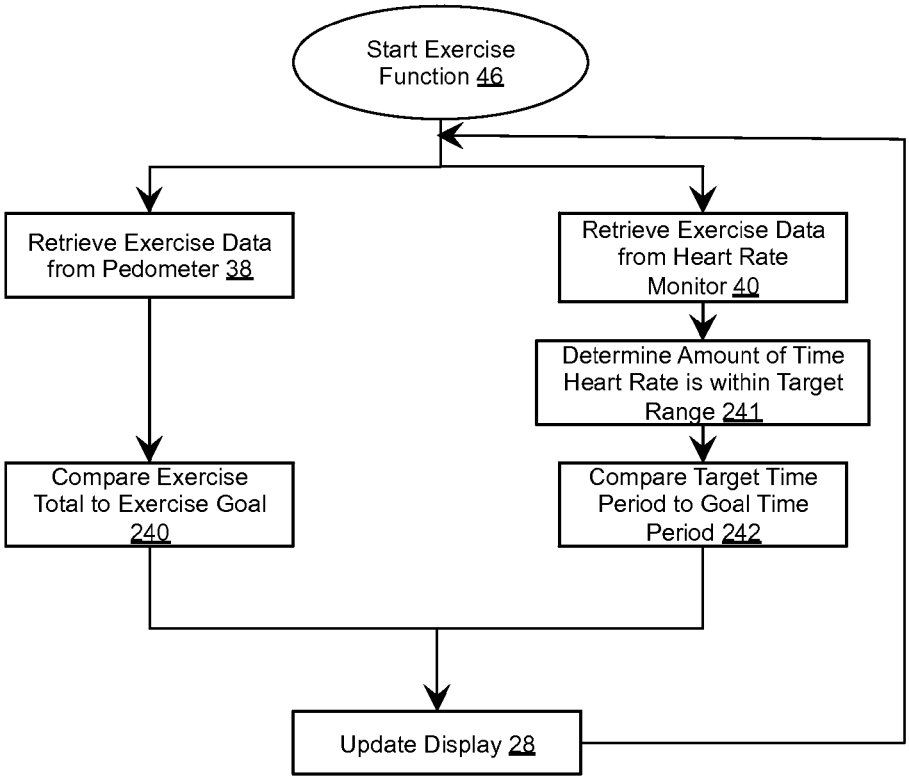

With reference to FIGS. 3*a-c*, illustrated are logical operations to implement exemplary methods of notifying a user of Islamic prayer time, aiding a user in prayer, and presenting exercise data. Executing an embodiment of the notification system 12, for example, may carry out the following exemplary methods. Thus, the flow diagram may be thought of as depicting steps of one or more methods carried out by the notification system 12. Although the flow charts show specific orders of executing functional logic blocks, the order of executing the blocks may be changed relative to the order shown, as will be understood by the skilled person. Also, two or more blocks shown in succession may be executed concurrently or with partial concurrence.

With continued reference to FIGS. 1-3, the notification system 12 may call the scheduling function 14 and exercise function 46. The scheduling function 14 may call a clock function 48 to determine the current local time. Next, the scheduling function 14 may determine the location of the device 210. Determining the location of the device may comprise querying the location module 36, e.g., a GPS receiver, to determine the current location or accessing the memory 20 to use a location previously entered via the control keys 32 or the communications interfaces 26. The system may call the direction function 44 to determine the direction of Qibla using the determined location 210 and electronic compass 30 output. The system 12 may then update the display 28. Updating the display 28 may consist of displaying the prayer icon 122 with or without associated timer, displaying the Wudo icon 120 with or without associated timer, not displaying either the Wudo icon 120 or prayer icon 122, updating the current local time 112, updating Azan time 110, updating the direction icon 130, and displaying the correct Rakha number 124. Updating the display 28 may also consist of removing the Wudo icon 120 and associated timer, prayer icon 122 and associated timer, direction icon 130, Azan time display 110, and/or Rakha number 124. Updating the display may also include displaying the exercise data. The displayed exercise data 135 may change from a first color, e.g., red, to a second color, e.g., green, as the user nears the exercise goal. The change from a first color to a second color may gradually occur, with all numbers changing at the same rate, or different numbers changing at different rate. The change from a first color to a second color may also occur with individual numbers changing beginning at a side, including from the top or bottom.

Next, the scheduling function 14 may check if the date or system location has changed 220 since the last update. If the date or location has changed, the database 16 is accessed to determine the prayer times and Rakha numbers 222 for the current location and date. After updating the prayer times and Rakha numbers 222, or if the date and location has not changed, the system 12 compares the current local time with the prayer times 223 to determine if prayer time is imminent 224, where an imminent prayer time may be 5 seconds or longer from a prayer time. If the prayer time is imminent, the display 28 is updated and/or the alarm function 14 is called. The display 28 may be updated such that the prayer icon 122 and Rakha number 124 flashes, while no other icons are illuminated. Alternatively, the display 28 may be updated so that neither the prayer icon 122 nor Rakha number 124 is displayed. The alarm function 14 may cause the device to vibrate and/or beep.

If prayer time is not imminent, then the current local time is checked to see if the current local time is within a duration of time, specified by the prayer threshold, from a prayer time 226. The prayer threshold is a shorter time than the Wudo threshold, e.g., 5 minutes. If the current local time is within the prayer threshold of a prayer time 226, then the display 28 is updated and/or the alarm function 14 is called. The display 28 may be updated by displaying the prayer icon 122, Rakha number 124, and/or a countdown indicator signifying the time until the nearest prayer time is reached. Alternatively, the display 28 may be updated so that neither the prayer icon 122, countdown indicator, nor Rakha number 124 is displayed.

The Wudo icon may not be displayed. The alarm function may beep or vibrate to signal that a prayer time is imminent.

If the current local time is not within the prayer threshold of a prayer time, then the current local time is checked to see if the current local time is within a duration of time, specified by the Wudo threshold, from prayer time 228. The Wudo threshold is a longer duration of time than the prayer threshold. The Wudo threshold provides a user sufficient time to perform Wudo, e.g., 20 minutes. If the current local time is within the Wudo threshold of a prayer time 228, then the display 28 is updated and/or the alarm function is called 14. The display 28 may be updated by displaying the Wudo icon 120 and/or a countdown indicator signifying the time until the next prayer time. Alternatively, the display 28 may be updated so that neither the Wudo icon 120 nor the countdown indicator is displayed. The prayer icon 122 may not be displayed, while the Rakha number 124 may be displayed. The alarm function may beep or vibrate to signal that a prayer time is imminent.

If the current local time is not within the Wudo threshold of a prayer time, then the display is updated and the clock function 48 is called and the process is repeated. The display may be updated to show the current local time 112 and Azan time 110. The display may also be updated such that neither the Wudo icon nor the prayer icon is displayed.

The exercise function 46 may retrieve exercise data from the pedometer 38 and/or heart rate monitor 40. The pedometer 38 may be used to monitor and record the number of steps taken by a user over a period of time. The period of time may be set by the user or may be set by the notification system 12 to a default value, e.g., 24 hours. The user may set an exercise goal for the number of steps to be taken over the period of time. The exercise goal may also be set by the notification system 12 to a default value, e.g., 15,000 steps for boys and 12,000 steps for girls.

The heart rate monitor 40 may be used to monitor and record the user's heart rate over time, the user's average heart rate, the user's maximum heart rate, the user's minimum heart rate, etc. The notification system 12 or user may set a heart rate exercise goal. The heart rate goal may comprise a heart rate target range and a goal time period. The goal time period may be an amount of time for which the user seeks to keep his heart rate within the heart rate target range. The heart rate target range may be determined by the notification system 12 as 60-80% of the user's maximum heart rate, where the user's maximum heart rate is equal to the user's age subtracted from 220. The user's maximum heart rate may also be determined by the notification system 12 as equal to 206.3 minus the product of the user's age and 0.67 or by some other method known in the art. The user may also set the user's maximum heart rate. The user or the notification system 12 period may set the goal time period. The notification system 12 may set the goal time period as a default value, e.g., 20-60 minutes depending on the fitness level of the user. The exercise function 46 may determine the amount of time the heart rate exercise data is within the heart rate target range 241. This amount of time may be stored as the actual time period. The exercise function may then compare the actual time period to the goal time period 242 and update the display 16 to indicate the user's progress towards the goal time period.

As will be apparent, the scheduling device 10 and notification system 12 may alert a user to approaching prayer times, while also recording and displaying exercise data from a pedometer and/or heart rate monitor.

Although certain embodiments have been shown and described, it is understood that equivalents and modifications falling within the scope of the appended claims will occur to others who are skilled in the art upon the reading and understanding of this specification.

What is claimed is:

1. A portable electronic device comprising a notification system, the device comprising:

a database storing information comprising:

a list of prayer times and Rakha numbers, the prayer times and the Rakha numbers associated with a selected location and date;

exercise data comprising an exercise goal and an exercise total;

a display;

an electronic compass;

a memory;

an alarm;

a pedometer;

a location module, wherein the location module is programmed to determine the system location;

a processor programmed to execute a program comprising a notification system, wherein the notification system comprises a scheduling function and an exercise function;

wherein the scheduling function is configured to:

convert from current local time to Azan time;

determine the direction of Qibla using an output from the electronic compass and the location module;

update the display to show the current local time, Azan time, and direction of Qibla;

compare the current local time to the prayer times for the current date and location as stored in the database, such that:

if a next prayer time is within a duration of time less than an amount of time specified by a predetermined Wudo threshold, issuing a notification via the alarm and/or updating the display to show a Wudo icon;

if the next prayer time is within a duration of time less than an amount of time specified by a predetermined prayer threshold, issuing a notification via the alarm and/or updating the display to show a prayer icon and/or the Rakha number of the next prayer time, where the prayer threshold consists of a shorter duration of time then the Wudo threshold; and if the current local time is equal to the next prayer time, issuing a notification via the alarm and/or updating the display;

wherein the exercise function is configured to:

retrieve pedometer exercise data from the pedometer;

update the exercise total; and compare the exercise total to the exercise goal and update the display to indicate a relationship between the exercise total and the exercise goal.

2. The notification system of claim 1, the exercise function further comprising:

retrieving heart rate exercise data from a heart rate monitor; and updating the display to present the heart rate exercise data.

3. The notification system of claim 2, the exercise goal from the heart rate monitor exercise data further comprising a heart rate target range and a goal time period;

the exercise total further comprising heart rate exercise data for a specified period of time;

the exercise function further comprising:

determining an actual time period, wherein the actual time period is equal to an amount of time the heart rate exercise data is within the heart rate target range;

comparing the actual time period to the goal time period; and updating the display to indicate the relationship between the actual time period and the goal time period.

4. The notification system of claim 1, wherein the Wudo icon and/or the prayer icon comprise a countdown indicator, wherein the countdown indicator signifies the time remaining until the next prayer time.

5. The notification system of claim 1, wherein if the current local time is within the prayer threshold the Wudo icon is not displayed and if the current local time is within neither the prayer threshold nor the Wudo threshold, neither the Wudo icon nor the prayer icon is displayed.

6. The notification system of claim 1, wherein the notification issued via the alarm comprises an audible signal, a tactile signal, a visual signal, or a combination thereof.

7. The notification system of claim 1, wherein the location module comprises a GPS receiver.

8. The notification system of claim 1, wherein the location module comprises information as to a current location received via user input.

9. The notification system of claim 1, wherein the exercise goal comprises a number of steps to be taken within a period of time and the exercise total from the pedometer is first displayed in a first color and transitions to being displayed in a second color when the exercise total is equal to or greater than the exercise goal.

10. The notification system of claim 9, wherein the exercise data readout progressively transitions from the first color to the second color starting from a side, as the exercise total increases.

11. A portable electronic device comprising:

a display;

an electronic compass;

an alarm;

a pedometer;

a processor;

a location module;

a memory; and a controller for managing the device operations such that the electronic device is configured to:

convert from current local time to Azan time;

display current local time and Azan time;

determine the direction of Qibla using an output from the electronic compass and the location module;

display the direction of Qibla;

determine prayer times for the current date and location;

record exercise data from the pedometer, the exercise data comprising an exercise goal and an exercise total;

display an indicator of the exercise data that represents progress towards the exercise goal;

activate the alarm and/or display a Wudo icon on the display when a next prayer time is within a duration of time less than a Wudo threshold;

activate the alarm and/or display a Prayer icon on the display when the next prayer time is within a duration of time less than a prayer threshold; and activate the alarm prior to the next prayer time.

12. The portable electronic device of claim 11, wherein the electronic device comprises a watch, timepiece other than a watch, or mobile phone.

13. The portable electronic device of claim 11, wherein the controller is configured to:

retrieve heart rate exercise data from a heart rate monitor, the exercise data further comprising a heart rate target range, a goal time period, and heart rate exercise data for a specified period of time; and update the display to present the heart rate exercise data.

14. The portable electronic device of claim 13, the exercise function further comprising:

determining an actual time period, wherein the actual time period is equal to an amount of time the heart rate exercise data is within the heart rate target range;

comparing the actual time period to the goal time period; and updating the display to indicate a relationship between the actual time period and the goal time period.

15. The portable electronic device of claim 11, further comprising a means for communicating with another electronic device, wherein the electronic device sends data to the other electronic device via the means for communicating.

16. The portable electronic device of claim 11, wherein the Wudo icon and/or prayer icon includes a countdown indicator, wherein the countdown indicator signifies the time remaining until the next prayer time.

17. The portable electronic device of claim 11, wherein if the current local time is within the prayer threshold the Wudo icon is not displayed and if the current local time is within neither the prayer threshold nor the Wudo threshold, neither the Wudo icon nor the prayer icon is displayed.

18. The portable electronic device of claim 11, wherein the alarm generates an audible signal, a tactile signal, a visual signal, or a combination thereof.

19. A method of presenting notifications relating to prayer and presenting exercise data with a portable electronic device, wherein the device comprises:

a display;

an electronic compass;

an alarm;

a pedometer;

a location module;

wherein the method comprises:

converting from current local time to Azan time;

displaying current local time and Azan time;

determining the direction of Qibla using an output from the electronic compass and the location module;

determining prayer times for a current date and location;

recording exercise data from the pedometer, the exercise data comprising an exercise goal and an exercise total;

displaying an indication of the exercise data that represents a progress towards the exercise goal;

activating the alarm and/or displaying a Wudo icon when a next prayer time is within a duration of time less than a Wudo threshold;

activating the alarm and/or displaying a Prayer icon when the next prayer time is within a duration of time less than a prayer threshold;

activating the alarm prior to the next prayer time.

20. The method of claim 19, wherein the device further comprises a heart rate monitor; and wherein the method further comprises retrieving exercise data from the heart rate monitor, the exercise data further comprises a heart rate target range, a goal time period, and heart rate exercise data for a specified period of time; and displaying the heart rate exercise data.

21. The method of claim 20, the method further comprising:

determining an actual time period, wherein the actual time period is equal to the amount of time the heart rate exercise data is within the heart rate target range;

comparing the actual time period to the goal time period; and displaying a visualization of a relationship between the actual time period and the goal time period.

22. The method of claim 19, wherein the Wudo icon and/or prayer icon includes a countdown indicator, wherein the countdown indicator signifies the time remaining until the next prayer time.

23. The method of claim 19, wherein if the current local time is within the prayer threshold the Wudo icon is not displayed and if the current local time is within neither the prayer threshold nor the Wudo threshold, neither the Wudo icon nor the prayer icon is displayed.

24. The method of claim 19, wherein the alarm comprises an audible signal, a tactile signal, a visual signal, or a combination thereof.

25. The method of claim 19, wherein the device further comprises one or more communications interfaces.

26. The method of claim 25, wherein the communications interfaces comprises one or more of a Bluetooth module, a Zigbee module, a wireless USB module, a USB connector, a mini-USB connector, a micro-USB connector, and a radio-frequency identification (RFID) chip.

* * * * *